US005226949A

United States Patent [19]

Schlienger

[11] Patent Number: 5,226,949

[45] Date of Patent: Jul. 13, 1993

[54] METHOD AND APPARATUS FOR REMOVAL OF FLOATING IMPURITIES ON LIQUID

[75] Inventor: Max E. Schlienger, Ukiah, Calif.

[73] Assignee: Retech, Inc., Ukiah, Calif.

[21] Appl. No.: 922,214

[22] Filed: Jul. 30, 1992

[51] Int. Cl.[5] ..... C22B 4/00

[52] U.S. Cl. ..... 75/377; 75/10.16; 75/10.23; 75/10.65; 373/18

[58] Field of Search ..... 75/377, 10.16, 10.23, 75/10.65; 373/18

[56] References Cited

U.S. PATENT DOCUMENTS 1,997,988 4/1935 Wever ..... 75/10.16
3,764,297 10/1973 Coad ..... 75/10.23
4,961,776 10/1990 Harker ..... 75/10.65

*Primary Examiner*—Peter D. Rosenberg
*Attorney, Agent, or Firm*—Townsend and Townsend Khourie and Crew

[57] ABSTRACT

A housing has a pair of chambers separated by a vertical wall. A hearth is on one side of the wall in the housing and is adjacent to an orifice which allows a stream of material, such as molten metal to pass from one chamber to the other. A gas is caused to flow through the orifice counter to the material flow by placing the other chamber at a higher fluid pressure than the one chamber. A blower coupled to the chambers provides the differential pressure. Molten metal is collected in a crucible in the other chamber. The gas flow moves through the orifice and forces impurities on the surface of the material to flow in reverse in the one chamber before the flow passes through the orifice.

13 Claims, 1 Drawing Sheet

METHOD AND APPARATUS FOR REMOVAL OF FLOATING IMPURITIES ON LIQUID

This invention relates to improvements in removal of floating impurities from a stream of liquid material and, more particularly, to apparatus and a method for forcibly moving such impurities in a predetermined direction relative to the upper surface of the liquid to be purified.

BACKGROUND OF THE INVENTION

A number of methods have been in use publicly for a number of years for separating the impurities floating on a molten mass of metal from the molten mass itself. For the most part, the conventional techniques have drawbacks which render them undesirable to purify.

A dam is often used for this purpose. For a dam to function properly, it must protrude into the molten metal so that its lower edge is below the surface of the metal. As a result, it must be constructed of materials that can withstand the thermal environment or alternately, the dam must be water cooled. A dam that is able to withstand temperatures of this environment must be made of either ceramic or graphite if not $H_2O$ cooled. Both of these materials are sources of contamination for many alloys. Both materials are subject to cracking of or reacting with the metal in this high temperature environment. As a result, dams made of these materials are often not acceptable for purifying the upper surface of a mass of molten metal.

Dams made of water-cooled copper may be used but they cause other problems. Since copper dams are cooled, they also have a tendency to cause the solidification of the metal around the dams. This action can make it difficult to achieve steady state material flow through the system. To counter this solidification, additional heat must be added in the neighborhood of the dam, thus allowing the area under the dam to remain molten. This technique generates extreme heat fluxes within the dam. As a result, the internal water passages of these dams scale up quickly and the dams are subject to a significant amount of thermally induced deformation. These effects contribute to high maintenance costs, short operating life and provide an opportunity for costly water leaks and low thermal efficiencies.

Another technique conventionally used is one known as oxide herding. This technique requires that a significant portion of the input power be used for herding of oxides. This can represent a process efficiency loss. It also puts a constraint on the patterning which may make some forms of process optimization impossible. Additionally, in the case of an "arc down" or momentary interruption of the herding heat source; the herding mechanism becomes immediately non-functional. This affords the opportunity for impurity flows to occur within the interval between the arc down and the moment that the torch or electron beam is restarted or that the metal solidifies. After restart, the slag may have moved to a location where recovery by the herding mechanism is impossible. Since at present technological levels arc downs do occur, this mechanism is not as efficient as it might be.

Because of these drawbacks of conventional techniques, a need exists for a more robust purification technique with the capability to make such a process more versatile for use and to reduce the cost of the purification while maintaining a high degree of purification of the metal.

SUMMARY OF THE INVENTION

The purification method and apparatus of the present invention uses a pressure differential technique to create a flow of a gas over the upper surface of a stream of material, such as a mass of molten metal. The technique can be operated with low maintenance and is not subject to arc downs, is non-intrusive, is non-contaminating and is easily variable. As a result, the apparatus and method of the present invention is superior to those currently in use in the molten metal field.

The pressure differential technique of the present invention is especially suited to the skimming or removal of floating contaminate material from the upper surface of a molten mass of metal. In an alternative method of carrying out the technique, a gas jet is directed onto a molten pool of metal, such as nickel (Ni), in the vicinity of a pour lip of a hearth. The gas jet successfully excludes floating impurities from the pour lip zone without detrimental effects on the melting or subsequent ingot formation. Although a gas jet is effective, optimum results occur when the gas flow is parallel or nearly parallel to a molten metal surface to be purified.

To achieve gas flow parallel to the surface requires that the jet of gas be in close proximity to the molten metal surface. This proximity is difficult to achieve for the following reasons:

1. The gas jet is destroyed if immersed in molten metal, and the molten metal level of the hearth is subject to variations.
2. Additional heat, usually sufficient to melt the jet, must often be added in the vicinity of the pour lip where the jet is most effective.

These phenomena make optimization of the gas jet problematical. A pressure differential system, however, provides a mechanism for significant surface gas flows parallel to the molten pool. These gas flows are relatively immune to variations in the metal level. Further, the barrier itself may be a wall which is water-cooled without having any impact on molten metal as its lifetime is long due to low thermal fluxes.

The technique of the present invention also has the inherent desirable characteristic of increasing surface gas velocities over the molten material as the gas barrier plate is approached. This feature provides a stronger exclusion force as the pressure barrier is approached and a gentler exclusion force as the distance from the barrier increases. Since material flows are moving the impurities toward the pressure barrier, there will be an intermediate position where impurities will naturally congregate. In the absence of other influences, such as plasma torches, electron beam spots and the like, the location of the impurities could actually be controlled by way of changes in the pressure difference across the barrier and the subsequent change in the gas flow that would result. Such control could prove to be advantageous tool for the subsequent removal of these impurities from the system.

The technique of the present invention is suitable for a number of processes. Applications range from food processing to hearth melting, the only requirement being that there be sufficient atmosphere to generate a "wind" of sufficient force to remove or "hold back" the floating component.

The primary object of the present invention is to provide apparatus and method for removing impurities from a stream of liquid material when the impurities float on the upper surface of the liquid material, and to thereby purify the liquid material by segregating the impurities so that they can be removed from a liquid material and discarded or used for other purposes.

Other objects of the present invention will become apparent as the following specification progresses, reference being had to the single figure of drawing for an illustration of the apparatus and method of the invention.

DETAILED DESCRIPTION OF THE DRAWING

Figure 1:
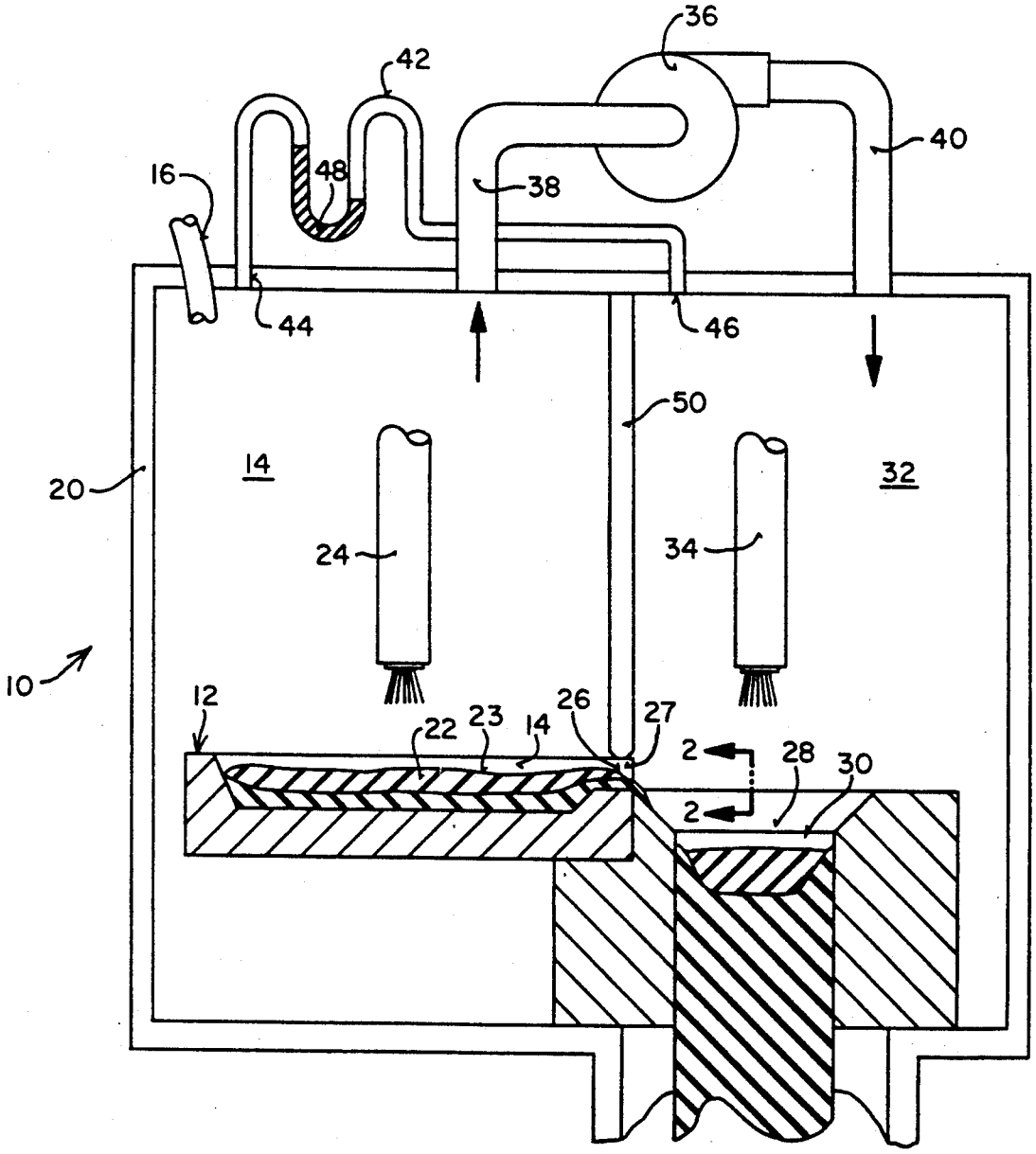
FIG. 1 is a schematic view of the apparatus.

In FIG. 1, apparatus 10 of the present invention will be described with respect to the melting of a nickel-based alloy in a cold hearth 12. In the example of the foregoing material, a nickel-based alloy, such as 718, is chargeable into chamber 14 through a materials inlet 16 on the side 18 of a housing or furnace enclosure 20. The materials 22 are melted into the hearth 12 by a plasma arc torch 24 so that the top portion 26 of the molten material will flow out of the hearth through an orifice or notch 27 (FIG. 2) and into the open top 28 of a crucible 30 for receiving the molten alloy from hearth 12.

Low density impurities typical of this type of alloy float to the surface 23 of the molten metal mass 22. Traditional processing techniques would, in this particular case, use dams to obstruct surface constituents and force the clean metal to flow underneath the dam or to use the surface tension and buoyancy flows around an electron beam or plasma arc termination spot or surface tension buoyancy flows and gas flows around a plasma torch arc impingement point to herd the oxides away from the inlet to the withdrawal crucible 30 in chamber 32 containing a second plasma torch 34 which directs its energy into the open top 28 of crucible 30.

A blower 36 has an inlet tube 38 communicating with chamber 14. An outlet tube 40 coupled to the blower 36 directs the flow of fluid through the blower into chamber 32. Thus, the blower provides a pressure differential between chambers 14 and 32 and this pressure differential can be measured by a manometer 42 having one end 44 in fluid communication with chamber 14 and the other end 46 in fluid communication with chamber 32. The charge of mercury or other fluid 48 in the manometer indicates that the pressure in chamber 32 is greater than the pressure in chamber 14.

Figure 2:
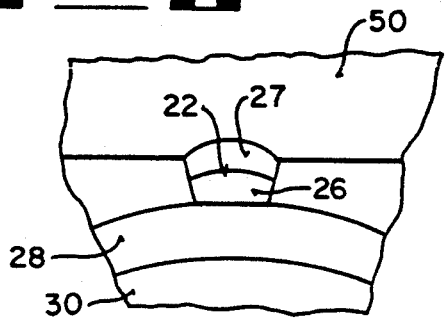
FIG. 2 is a view taken along line 2—2 of FIG. 1.

A gas barrier 50 in the form of an imperforate wall 52 is secured to the inner surface 54 of housing 20 and extends downwardly and terminates at a lower end edge 56 which is spaced above the lower lip or notch 26 of hearth furnace 12 as shown in FIG. 2. Thus, the notch 26 presents a gap for allowing molten metal to flow out of the hearth 12 and to fall into the open top 28 of crucible 30.

The gas flow from chamber 32 to chamber 14 due to the pressure differential is a flow counter to the flow of liquid material or molten metal. The gas flow effectively blows the oxides floating on the surface of the molten metal away from the exit lip or notch 26. Thus, the gas flow protects the ingot being formed in the crucible 30 from the floating contaminants. The effect is analogous to the situation in which leaves in a swimming pool will collect at one end of the pool when the wind is blowing.

The pressure differential may be actively generated by the use of blower 36 or in those processes where a gas is used for other processing aspects, passively generated by arrangement of the exhaust and gas inlets. The gas circulates through chambers 14 and 32 and through blower 36 and pipes 38 and 40.

I claim:

1. A method of separating impurities from the upper surface of a stream of material having an upper surface comprising:

directing a volume of said material stream out of a first space and through an orifice;

collecting the material stream in a second space after the material stream has passed in one direction through the orifice; and moving a gas flow through the orifice in the opposite direction as a function of the fluid pressure difference between the spaces sufficient to impede the impurities floating on the surface of the material stream and confining them to the first space.

2. A method as set forth in claim 1, wherein said material stream is a mass of molten metal.

3. A method as set forth in claim 1, wherein said material is a mass of molten metal and including the step of heating the material in the first space to melt the material and to cause a flow of molten material into the second space, the first and second spaces being in fluid communication with each other at said orifice.

4. A method as set forth in claim 1, wherein is included the step of providing a housing and dividing the housing into said pair of spaces with the orifice placing the two spaces in fluid communication with each other, and keeping the one space at a pressure difference from the other space.

5. A method as set forth in claim 1, wherein the step of moving a gas through the orifice includes generating a fluid pressure differential between the spaces.

6. A method as set forth in claim 1, wherein is included the step of heating the material in said first space to a molten condition.

7. Apparatus for separating impurities from the upper surface of a liquid stream comprising:

a housing having a wall defining a barrier and presenting a pair of adjacent chambers, said wall having a lower end portion spaced above the bottom of the housing to present an opening placing the two chambers in fluid communication with each other;

means in one chamber for directing the liquid stream through the orifice in one direction;

means for generating a flow of a gas through the orifice in the opposite direction as a function of the pressure difference in the chamber so that the gas will flow counter to the flow of material through the opening sufficient to clean the upper surface of the stream and prevent impurities from entering the second chamber with the flow of liquid thereinto.

8. Apparatus as set forth in claim 7, wherein said wall is imperforate and has outer peripheral portions secured to adjacent inner portions of the housing.

9. Apparatus as set forth in claim 7, wherein the directing means includes a hearth having one end adjacent to the orifice, said hearth adapted to receive a material to be placed in a liquid form, and means for heating the material in the hearth for melting the material and for placing it in a molten condition for flow from the hearth to and through the orifice.

10. Apparatus as set forth in claim 9, wherein the hearth has an open top, said heating means includes a plasma torch above the hearth for heating the material therein to a molten state.

11. Apparatus as set forth in claim 7, wherein is included a crucible or an additional hearth at the downstream side of the orifice for receiving the molten material therefrom.

12. Apparatus as set forth in claim 7, wherein said generating means includes means for causing a fluid pressure differential across said orifice.

13. Apparatus as set forth in claim 12, wherein the causing means includes a blower having an inlet coupled to said one chamber and an outlet coupled to the other chamber.

* * * * *